US006422266B1

(12) United States Patent
Gouzou et al.

(10) Patent No.: US 6,422,266 B1
(45) Date of Patent: Jul. 23, 2002

(54) LIQUID TRANSFERRING ASSEMBLY, IN PARTICULAR FOR FUEL ADDITIVE

(75) Inventors: Christophe Gouzou, Chalons-en-Champagne; Eric Renard, Recy, both of (FR)

(73) Assignee: Marwal Systems (FR)

( * ) Notice: Subject to any disclaimer, the term of this patent is extended or adjusted under 35 U.S.C. 154(b) by 0 days.

(21) Appl. No.: 09/720,044

(22) PCT Filed: Jun. 15, 1999

(86) PCT No.: PCT/FR99/01417

§ 371 (c)(1),
(2), (4) Date: Dec. 15, 2000

(87) PCT Pub. No.: WO99/66188

PCT Pub. Date: Dec. 23, 1999

(30) Foreign Application Priority Data

Jun. 16, 1998 (FR) ..... 98 07574

(51) Int. Cl.[7] ..... F02M 25/00; F02M 37/10

(52) U.S. Cl. ..... 137/565.22; 137/565.24; 123/1 A

(58) Field of Search ..... 137/565.34, 565.24, 137/565.22; 417/363; 123/1 A

(56) References Cited

U.S. PATENT DOCUMENTS

| | | | | |
|---|---|---|---|---|
| 4,253,428 A | * | 3/1981 | Billings et al. | 123/1 A |
| 5,331,994 A | * | 7/1994 | Bryan, III et al. | 123/1 A X |
| 6,216,734 B1 | * | 4/2001 | Umetsu et al. | 137/565.24 |

FOREIGN PATENT DOCUMENTS

| | | | |
|---|---|---|---|
| DE | 39 12 773 | 7/1990 | F02M/37/10 |
| EP | 0 378 796 A2 | 7/1990 | B60K/15/00 |
| EP | 0 758 589 A2 | 2/1997 | B60K/15/03 |
| FR | 2718795 | 10/1995 | F02M/25/00 |
| GB | 2176842 | 1/1987 | F02M/25/00 |

* cited by examiner

*Primary Examiner*—John Rivell
(74) *Attorney, Agent, or Firm*—Blakely Sokoloff Taylor & Zafman

(57) ABSTRACT

The assembly comprises a module supported in the reservoir by side plate, with outlet to fuel tank, return inlet and electrical power socket. The module housing, with end cap, forms an intermediate reservoir for the liquid, which is collected there by the venturi pump activated by flow in the return line from the main tank when pressure in the outlet is exceeded. The main pump is horizontally mounted and preferably electrically-driven. The pump is secured in the holder with side engaging clips.

17 Claims, 5 Drawing Sheets

110
160
126
121
139
116
130
154
124
158
120
114
122

120
121
134
130
132
122
124
VI
160
IX
IX
126
136
138
110
112
VI 120
122
114
121
134
130
132
124
118
X
X
X
X
VII
VII
126
139
116
1160
110
160

LIQUID TRANSFERRING ASSEMBLY, IN PARTICULAR FOR FUEL ADDITIVE

The present invention relates to the field of drawing liquid from a tank.

Document EP-A-0 758 589 describes a module for extracting fluid that comprises a pump associated with a filter device placed in a baffle-forming double enclosure. Each of the two enclosures has an open side wall to allow ingress of the liquid to be pumped.

The present invention applies particularly, but not exclusively, to transferring additive from a special tank on board a motor vehicle to a fuel tank.

In spite of the large amount of work undertaken in the field of fuels and in particular of fuel additives, few vehicles are presented fitted with means on board the vehicle suitable for injecting an appropriate quantity of additive into the fuel tank.

It seems that is due particularly to the fact that the additive injectors that have been proposed in the past are too complex, too expensive, and not reliable.

The present invention seeks to improve known liquid-drawing devices.

In the context of the present invention, this object is achieved by a liquid-drawing assembly, in particular for fuel additive, the assembly comprising a module comprising a case, a pump disposed with its axis horizontal inside the case, and support-forming means which carry the pump close to the bottom of the case, the assembly being characterized by the fact that the case is constituted by a trough that is upwardly open to form a positive reserve.

According to an advantageous characteristic of the invention, the means forming a support for the pump define a resilient support.

According to an advantageous characteristic of the invention, the support means are formed by a cradle integrally molded in the case.

Other characteristics, objects, and advantages of the present invention will appear on reading the following detailed description, with reference to the accompanying drawings, given by way of non-limiting example and in which.

Figure 10:
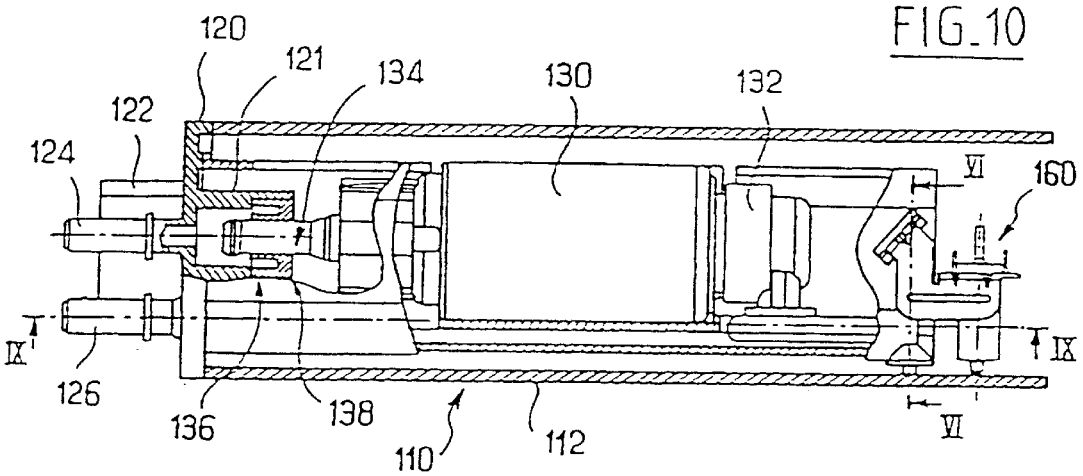
Figure 11:
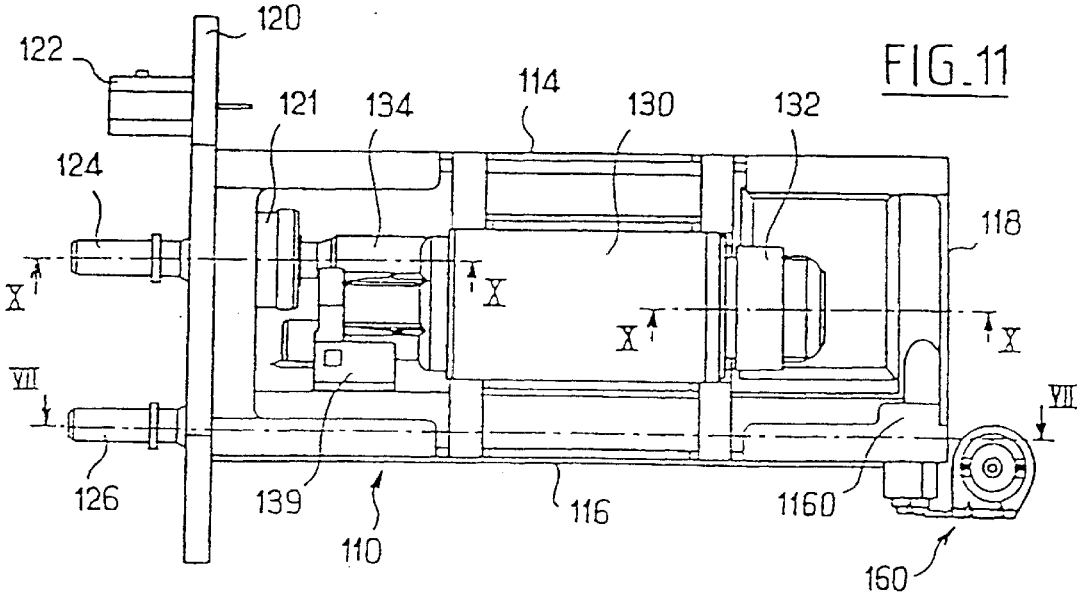

FIG. 10 comprises fragmentary vertical section views on the section planes referenced X—X in FIG. 11; and FIG. 11 is a plan view of the liquid-drawing assembly of the present invention.

Figure 1:
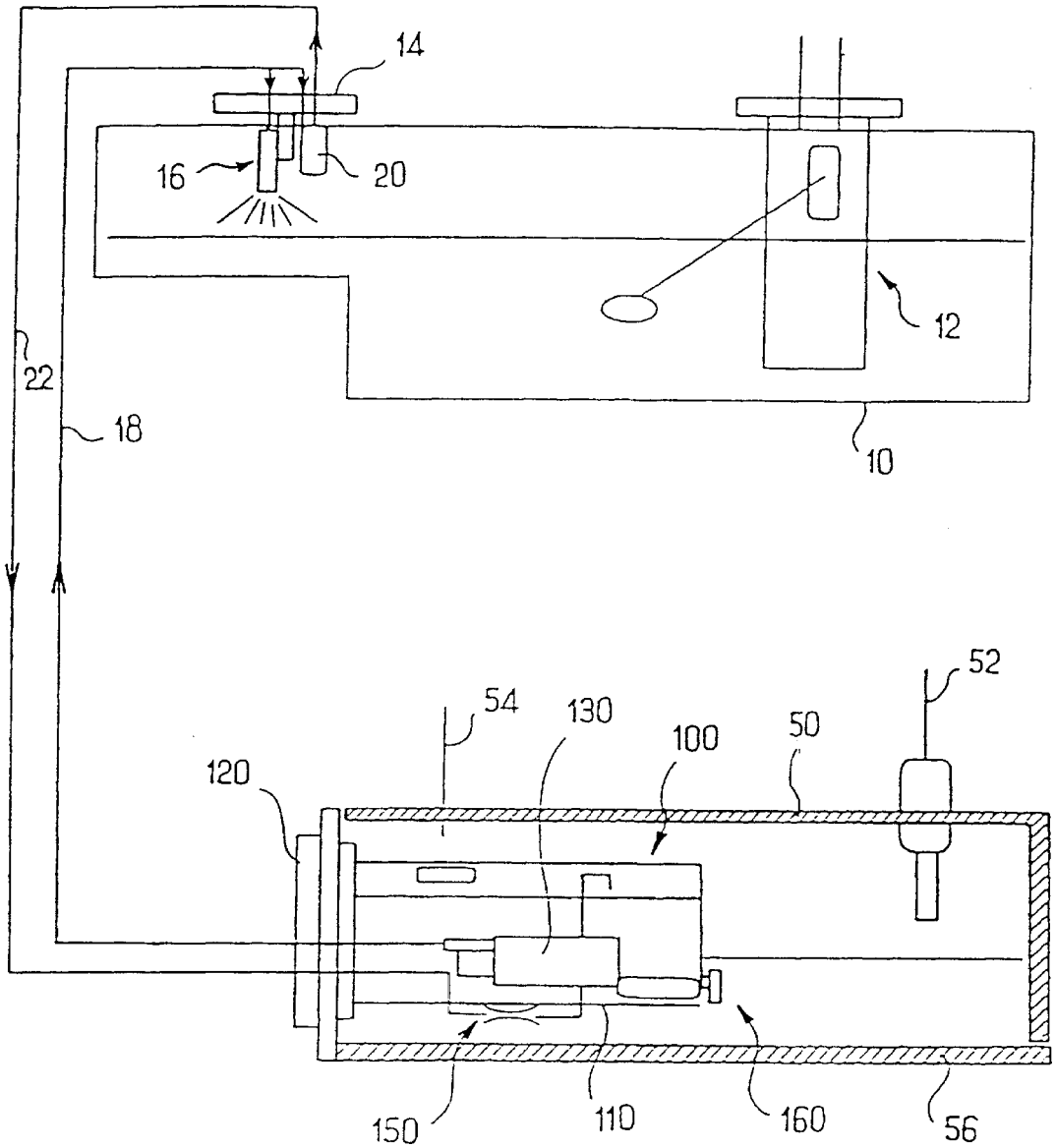
FIG. 1 shows the general architecture of a device for injecting additive into a motor vehicle fuel tank in accordance with the present invention.
Figure 2:
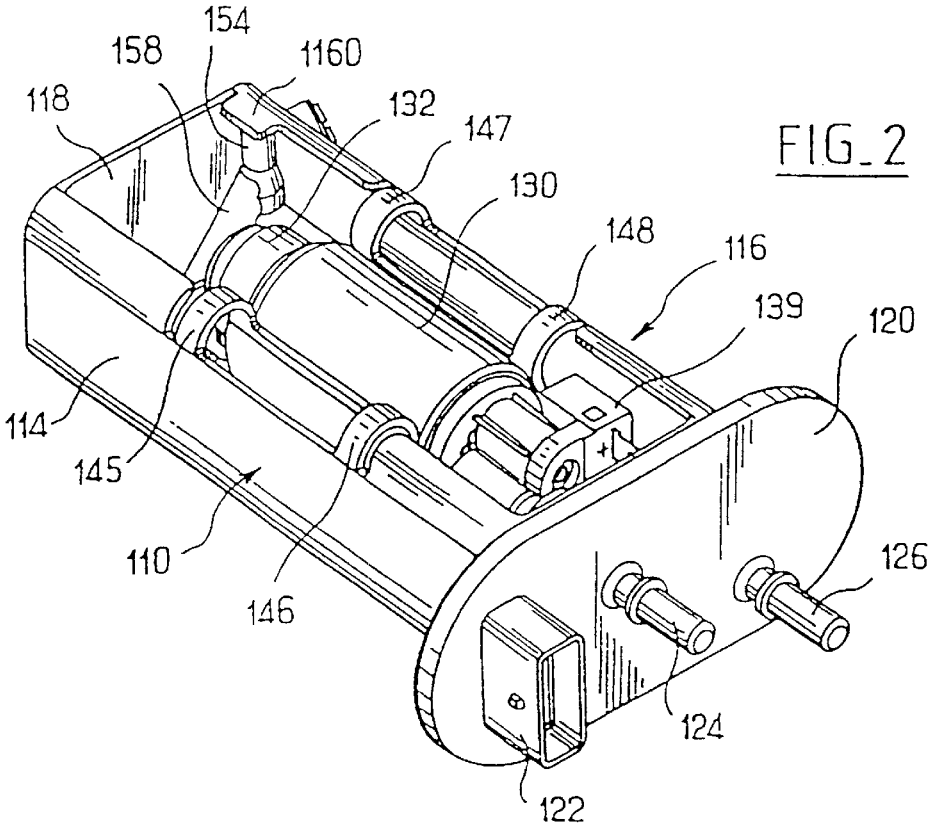
FIGS. 2 and 3 are diagrammatic perspective views of the liquid-drawing assembly of the present invention.
Figure 3:
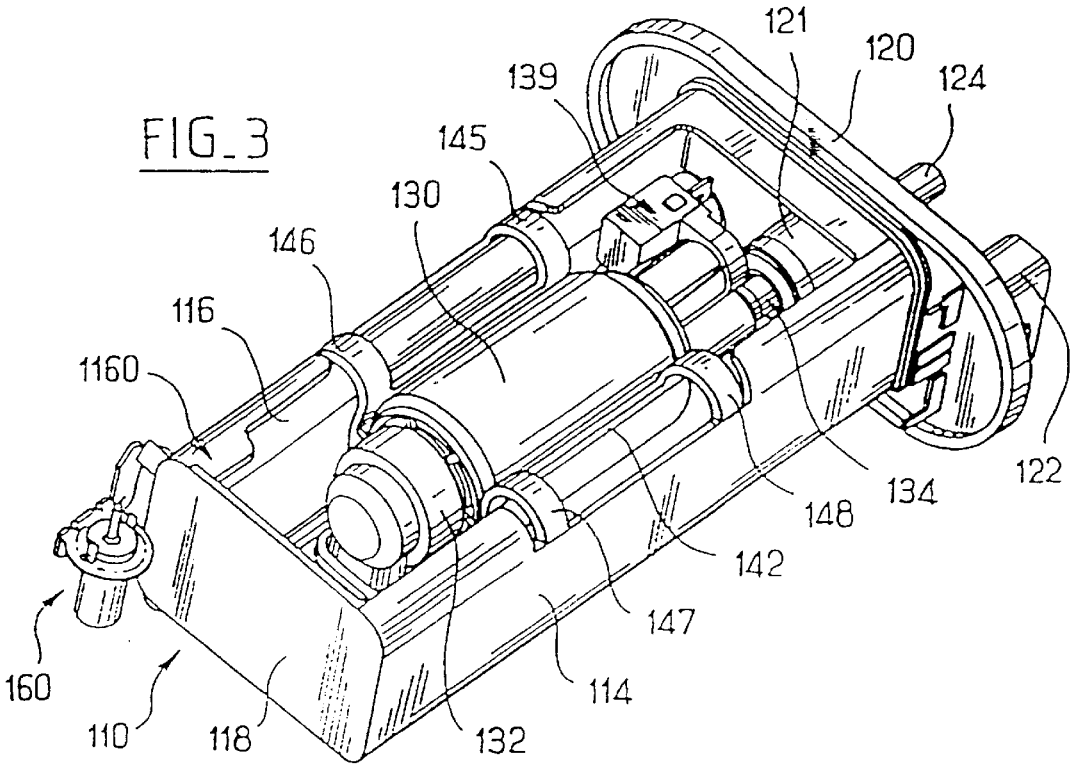
Figure 4:
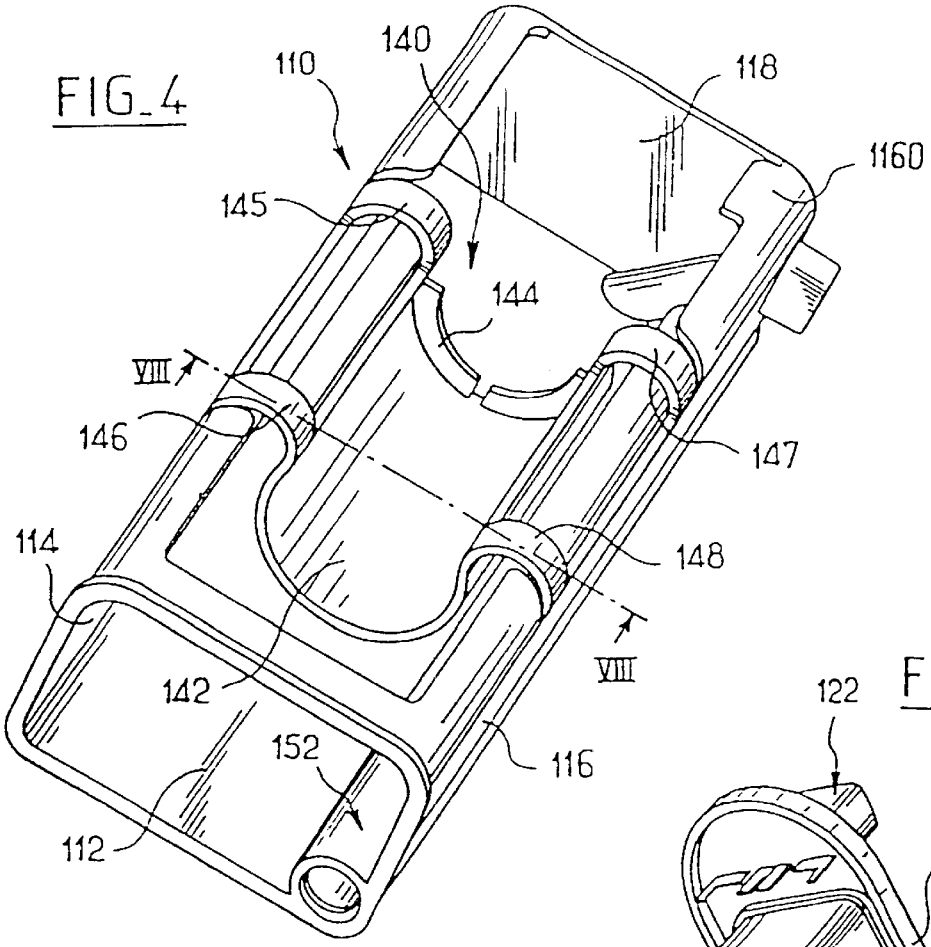
FIG. 4 is a perspective view of the case of the liquid-drawing assembly.
Figure 5:
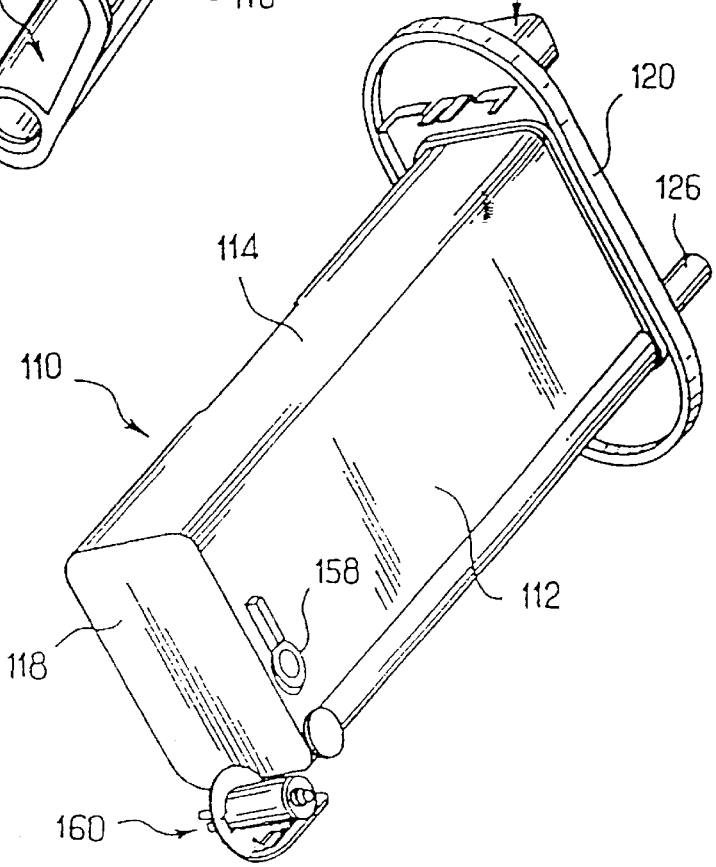
FIG. 5 is another perspective view, seen from beneath, of the liquid-drawing assembly.
Figure 6:
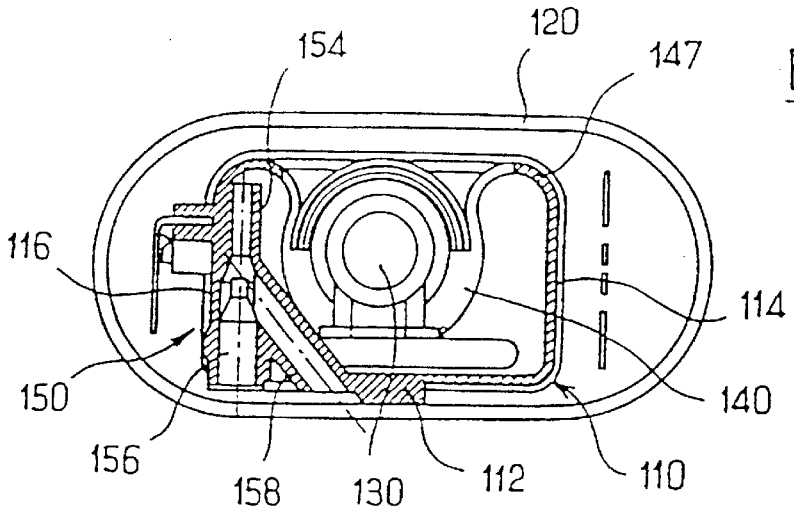
FIG. 6 is a vertical section view through the liquid-drawing assembly on a section plane referenced VI—VI in FIG. 10.
Figure 7:
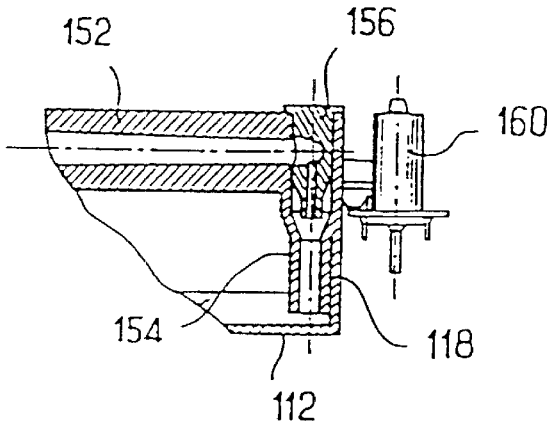
FIG. 7 is a fragmentary vertical section of the liquid-drawing assembly on a section plane referenced VII—VII in FIG. 11.
Figure 8:
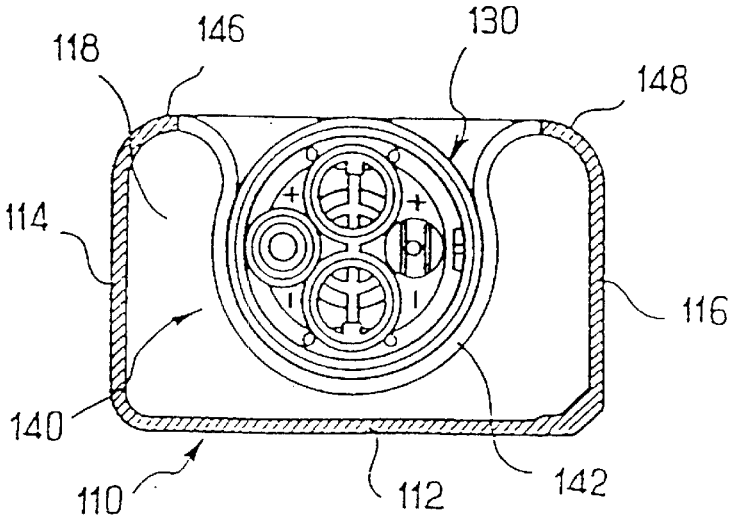
FIG. 8 is another vertical section view of the liquid-drawing assembly on a section plane referenced VIII—VIII in FIG. 4.
Figure 9:
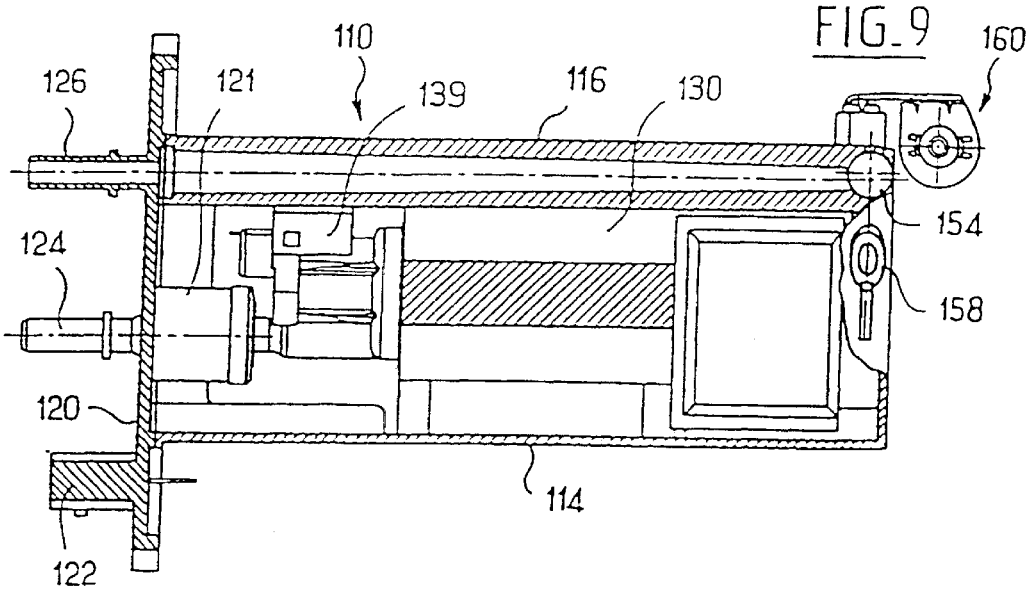
FIG. 9 is a horizontal section view of the liquid-drawing assembly on a section plane referenced IX—IX in FIG. 10.

Accompanying FIG. 1 shows the general architecture of a system in accordance with the invention for injecting additive into a motor vehicle fuel tank.

In FIG. 1, there can be seen a fuel tank given reference 10. It is fitted with an assembly 12 for drawing and gauging fuel. This fuel-drawing assembly 12 is adapted to direct fuel to the carburetor and/or the injectors of the vehicle in order to feed the engine.

Such a fuel-drawing and fuel-gauging assembly 12 can be implemented in any conventional manner known to the person skilled in the art and is therefore not described in detail below.

It should be observed that the fuel tank 10 is fitted with a support plate 14 suitable for fixing to a wall of the tank 10, and preferably to the top wall thereof.

The support plate 14 carries an injector 16 at the outlet from a duct 18 that comes from an additive tank 50.

The support plate 14 preferably also carries a pressure regulator 20 adapted to return excess additive coming from a duct 18 via a duct 22, in the event of the pressure of the additive in the duct 18 exceeding a predetermined threshold.

This disposition makes it possible to control the open time of the injector 16. Since the injection pressure is controlled by the regulator 20, controlling the open time of the injector 16 makes it possible in simple manner to control the flow rate delivered by the injector 16, and consequently to control the quantity of additive injected into the fuel tank 10.

The injector 16 and the regulator 20 can be constituted by any structure known to the person skilled in the art.

It should be observed that the regulator 20 is preferably formed essentially by a valve whose moving valve member is secured to a diaphragm that is subjected to opposing forces firstly by a rated spring and secondly by the pressure of the additive in the duct 18. When the pressure of additive in the duct 18 exceeds the rated threshold of the spring acting on the above-mentioned diaphragm, the valve member of the regulator is separated from its seat so as to allow additive coming from the duct 18 to be diverted to the return duct 22 associated with the outlet of the regulator 20.

The additive tank is referenced 50 in the accompanying figures.

This additive tank 50 can be filled by any suitable known means.

It will be observed that in the preferred embodiment of the invention, the additive tank 50 is fitted on its top wall with two ducts 52 and 54.

The duct 52 is designed to be connected to the outlet of an additive supply external to the vehicle, e.g. at a service station, for transferring additive into the tank 50.

The duct 54 has its inlet preferably situated at the maximum level authorized for additive inside the tank 50. The duct 54 is connected during filling to a return duct which leads to the above-mentioned supply.

Thus, if the maximum level of additive inside the tank 50 is reached, then excess additive is returned to the supply via the duct 54. If the duct 54 or the associated duct connected to the supply is made at least in part out of transparent material, then the flow of additive along the duct 54 serves to indicate when the tank 50 is full.

Such means for filling the additive tank 50 are defined in a parallel patent application filed in the name of the Applicant.

The ducts 18 and 22 connected respectively to the injector and to the outlet of the regulator 20 are connected to and co-operate with a fluid-drawing module 100 disposed inside the additive tank 50, close to the bottom 56 thereof. This fluid-drawing module 100 constitutes the basis of the present invention and is described below in detail.

The module 100 essentially comprises a case 110 which forms an auxiliary supply inside the tank 50, a pump 130, pump support means 140, a Venturi effect pump 150, and a sensor 160 for sensing the minimum level inside the tank 50.

The case 110 is in the form of an elongate trough or drawer, of rectangular outline and upwardly open.

The case 110 has a plane and rectangular bottom 112 provided with two longitudinal walls 114, 116 and with at least one transverse end wall 118 orthogonal to the longitudinal walls and connected thereto in leakproof manner.

The end of the case 110 remote from the end wall 118 is fixed in leakproof manner to a vertical support plate 120. This plate is preferably of dimensions that are greater than the section of the case 110. The support plate 120 can thus constitute one of the end walls of the additive tank 50. By way of non-limiting example, the case can be fixed to the support plate 120 by heat-sealing, e.g. by ultrasound, hot blade, or any other equivalent means, or indeed by adhesive.

The support plate 120 carries firstly an electrical connector 122 for providing electrical connections to the pump 130 and the level sensor 160, and two spigots 124, 126 for connection to the above-mentioned ducts 18 and 22, respectively.

The pump 130 is preferably an electric pump whose rotor has its axis parallel to the bottom 112 of the case 110, i.e. horizontal in use. This disposition enables the module 100 to be made so that its vertical extent is small.

The inlet of the pump 130 is fitted with an endpiece 132 which opens out close to the bottom of the case 110. This endpiece 132 is preferably fitted with a primary filter.

The pump 130 is placed in the support means 140. The support means are preferably integrally molded in the case 110.

In the preferred embodiment shown in the accompanying figures, the support means 140 comprise a cradle 142 in the form of a generally semicylindrical trough having a horizontal axis parallel to the bottom 112. The cradle 142 is situated inside the case 110 and is open towards the top thereof. Its angle at the center is greater than 1800.

The inside radius of the cradle 140 is complementary to the radius of the outer envelope of the electric pump 130.

Thus, the cradle 142 receives the pump 130 by elastic deformation and serves to retain it.

Where appropriate, one of the axial ends of the cradle 142 can be provided with an end plate 144 with radial openings complementary to a segment of the pump 130 so as to retain it axially.

The top edges of the trough 142 are connected to the top edges of the longitudinal walls 114, 116 of the case by resilient support clips. More precisely, and preferably, each top edge of the cradle 142 is connected to the top edge of the corresponding longitudinal wall 114, 116 by a pair of acuate spring clips 145 & 146, 147 & 148.

The clips in each pair 145 & 146, 147 & 148 are generally in the form of half-cylinders with their concave sides facing towards the bottom 112 of the case.

In addition, and preferably, as can be seen in the figures, the top edges of the vertical walls of the case 100, and in particular its longitudinal walls 114, 116 are provided with cantilevered-out extensions directed towards the center of the top of the case 110 to confine the additive inside the case 110 and prevent it slopping out, particularly in the event of cornering or acceleration.

The purpose of the Venturi effect pump 150 is to use the additive returned by the duct 22 to suck additive in from the tank 50 and to transfer it into the case 110.

The Venturi effect pump 150 can be constituted by any conventional structure known to the person skilled in the art. It has an inlet connected to the outlet of the duct 22, a suction inlet which communicates with the tank 50, and an outlet which opens out into the case 110.

The body of the Venturi effect pump 150 is preferably integrally molded with the case 110.

The accompanying figures show in particular a longitudinal duct 152 integrally molded with the case 110 where the bottom 112 joins the longitudinal wall 116. At its front end, this duct 152 is designed to be connected to the spigot 126 which is itself connected to the duct 22. At its rear end, the duct 152 opens out into a vertical tube 154 that is integrally molded with the case 110 where the longitudinal wall 116 joins the end wall 118.

More precisely still, the rear end of the duct 152 opens out into an injector insert 156 that is fitted in sealed manner to the base of the tube 154. The nozzle of the injector 156 is directed towards the top of the tube 154 which opens out into the internal volume of the case 110.

The outlet from the Venturi effect pump 150 is thus constituted by the top of the tube 154.

A sloping duct 158 is also integrally molded with the case 110 adjacent to the end wall 118, with the inlet of the duct 158 opening out through the bottom 112 of the case 110, and its outlet opens out into the vertical tube 154 downstream from the nozzle 156.

The depth of the positive reserve inside the case 110 is equal to the height of the vertical tube 154.

The person skilled in the art will understand that the quantity of additive introduced into the case 110 by the tube 154 is equal to the sum of the flow coming from the return duct 22 and injected through the nozzle 156 plus the flow sucked in from the tank 50 via the sloping duct 158.

The outlet from the pump 130 is connected to the spigot 124 by any appropriate known means.

As can be seen in FIG. 10, in the preferred embodiment of the present invention, the support plate 120 is provided on its inside face directed towards the inside of the case 110 with an endpiece 121 that is concentric with the spigot 124.

The outlet spigot 134 from the pump 130 is engaged in this endpiece 121. Sealing between the spigot 134 and the endpiece 121 is provided by a lip gasket 136 held by a cup 138.

As can be seen in the accompanying figures, the pump 130 is preferably associated with conventional interference-suppressor means 139.

The level sensor 160 is adapted to indicate when the level of additive inside the tank 50 reaches a minimum threshold.

Such a level sensor 160 can be implemented in numerous ways.

As non-limiting examples, it can be formed by a simple thermistor or by an electric contact controlled by a float. If the thermistor is fed at constant current, for example, then its rate of cooling differs depending on whether the thermistor is in air or is dipped in additive. Consequently, measuring the voltage across the terminals of the thermistor provides a direct indication as to whether the thermistor is dipped in additive or is placed in air, in which case the minimum threshold level has been reached.

It will be observed that the module 100 of the present invention constitutes a cartridge that is easily fitted inside the additive tank 50.

The cartridge constituted by the case 110 can be fixed permanently, i.e. definitively inside the tank 50, e.g. by heat-sealing or adhesive. However, in a variant, the cartridge 110 can be fixed removably and thus be dismantled from the tank 50. Under such circumstances, means are naturally provided to provide sealing between the case 110 and the tank 50.

Because of its small number of component parts, such a module is very simple and consequently very reliable.

It would also be observed that the module is of small vertical extent, its height typically be less than 70 mm. The smallest dimension of the case 110 is its height and this is considered as being the vertical direction with reference to its normal in-use position.

The inlet of the Venturi effect pump 150 can be situated in the immediate vicinity of the bottom of the tank 50, typically at a distance of less than 2 mm therefrom. Thus, the present invention enables liquid to be drawn effectively from the inside of the tank 50 even when the depth of additive is low.

In one variant, the level sensor 160 can be provided inside the case 110, e.g. on the endpiece 132 receiving the inlet filter of the pump. Under such circumstances, the gauged level is the level inside the case 110 and not the level inside the tank 50.

In another variant, a check valve is provided on the duct 126.

According to an advantageous characteristic of the present invention, means are provided to form a deflector placed facing the outlet of the jet pump 150, i.e. above the top of the vertical duct 154. These deflector means are preferably integrated in a cantilevered-out extension 1160 of the wall 116. Such a deflector is designed to ensure that the jet pump 150 is self-priming, by initially returning liquid from the jet pump nozzle to the inside of its Venturi when the rate injected into the jet pump is below a threshold. Such a deflector can be constituted, for example, by a generally hemispherical cavity on the outlet axis of the jet pump 150 with its concave side facing towards it. An example of such a deflector is described in document FR-A-2 753 658 to which reference can usefully be made. That is why such a deflector is not described in detail herein.

What is claimed is:

1. A liquid-drawing assembly, comprising a module comprising a case, a pump disposed with its axis horizontal inside the case, and support-forming means which carry the pump close to the bottom of the case, wherein the case is constituted by a trough that is upwardly open to form a positive reserve, said assembly being designed to be placed in a tank of additive for motor vehicle fuel, and said assembly comprising furthermore a Venturi effect pump designed to inject additive in the case by sucking it in said tank under the effect of an excess return flow, and comprising a level sensor provided in said case.

2. An assembly according to claim 1, characterized by the fact that the means forming a support for the pump define a resilient support.

3. An assembly according to claim 1, characterized by the fact that the support means constitute a cradle integrally molded in the case.

4. An assembly according to claim 1, characterized by the fact that the pump support means comprise a cradle in the form of a semicylindrical trough of inside radius complementary to the radius of the envelope of the pump about an angular sector that is greater than 180°.

5. An assembly according to claim 4, characterized by the fact that the cradle is connected to the case via resilient support clips.

6. An assembly according to claim 1, characterized by the fact that the module forms a cartridge.

7. An assembly according to claim 1, characterized by the fact that the case has a flat bottom provided with two longitudinal walls and at least one end wall.

8. An assembly according to claim 7, characterized by the fact that a case-forming trough is fixed in leakproof manner to a support plate including an electrical connector and spigots.

9. An assembly according to claim 1, characterized by the fact that the body of the Venturi effect pump is integrally molded with the case.

10. An assembly according to claim 1, characterized by the fact that the Venturi effect pump possesses a vertical outlet duct.

11. An assembly according to claim 10, characterized by the fact that it includes a deflector facing the outlet of the Venturi effect pump.

12. An assembly according to claim 11, characterized by the fact that the deflector is adapted to return liquid to the inside of the Venturi effect pump when the flow rate injected by said pump is below a threshold.

13. An assembly according to claim 10, characterized by the fact that the defector is formed by a cantilevered extension from a wall of the case.

14. An assembly according to claim 1, characterized by the fact that the level detector is placed on an endpiece receiving the inlet filter of the pump.

15. An assembly according to claim 1, characterized by the fact that its height is less than 70 mm.

16. A tank fitted with an assembly according to claim 1.

17. An assembly according to claim 1, wherein said support-forming means comprises a cradle which is complementary of a part of the pump to retain it.

* * * * *